US006520632B1

(12) United States Patent
Yamazaki et al.

(10) Patent No.: US 6,520,632 B1
(45) Date of Patent: Feb. 18, 2003

(54) INKJET PRINTER HAVING A CONNECTION BLOCK WHICH AUTOMATICALLY ELIMINATES BUBBLES TRAPPED ON A FILTER

(75) Inventors: Tsutomu Yamazaki, Nagano (JP); Toshio Nakata, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 249 days.

(21) Appl. No.: 09/679,613

(22) Filed: Oct. 5, 2000

(30) Foreign Application Priority Data

Oct. 6, 1999 (JP) ..... 11-286066

(51) Int. Cl.[7] ..... B41J 2/19; B41J 2/175
(52) U.S. Cl. ..... 347/92; 347/93
(58) Field of Search ..... 347/93, 92, 65

(56) References Cited

U.S. PATENT DOCUMENTS

| | | | | | |
|---|---|---|---|---|---|
| 5,495,272 | A | * | 2/1996 | Yamaguchi | 347/28 |
| 5,828,395 | A | | 10/1998 | Takata | |
| 6,158,855 | A | * | 12/2000 | Saikawa | 347/93 |
| 6,250,752 | B1 | * | 6/2001 | Tajima et al. | 347/92 |
| 6,270,212 | B1 | * | 8/2001 | Kusumi et al. | 347/93 |
| 2002/0012034 | A1 | * | 1/2002 | Saikawa | 347/93 |
| 2002/0109762 | A1 | * | 8/2002 | Usui et al. | 347/93 |

FOREIGN PATENT DOCUMENTS

| | | |
|---|---|---|
| EP | 0 609 863 | 8/1994 |
| EP | 0 645 244 | 3/1995 |
| EP | 0 802 058 | 10/1997 |
| EP | 0 945 272 | 9/1999 |
| GB | 2 299 786 | 10/1996 |
| JP | 62-257857 | 11/1987 |
| JP | 1-306257 | 12/1989 |
| JP | 7-117239 | 5/1995 |
| JP | 9-94978 | 4/1997 |
| JP | 9-141890 | 6/1997 |
| JP | 11-78046 | 3/1999 |

* cited by examiner

*Primary Examiner*—Judy Nguyen
(74) *Attorney, Agent, or Firm*—Nixon & Vanderhye P.C.

(57) ABSTRACT

An inkjet printer that automatically expels bubbles trapped at a filter—which removes foreign materials from ink supplied to the inkjet head—to eliminate ink discharge problems caused by trapped air bubbles. Ink (40) is supplied through ink-supply-line part (23), filter (24), and ink-intake opening (202) to inkjet head (2) of inkjet printer (1). If a bubble (30) in ink (40) becomes trapped at the top surface (24*a*) of filter (24), the bubble (30) is separated from the filter top (24*a*) by the buoyancy of the ink (40). When the bubble (30) separates from the filter top (24*a*), it forms a spherical bubble (30A). This spherical bubble (30A) then rises through conically shaped ink-path-connection part 222 and ink-supply-line part 23. The internal volume of ink-path-connection part 222 is less than 1.1 times the volume of a sphere internally tangent to ink-supply-line part 23. Therefore, bubble (30A) freely rises through ink-supply-line part 23. Print defects that occur when a bubble (30) is trapped at the filter top are, therefore, prevented.

13 Claims, 8 Drawing Sheets

INKJET PRINTER HAVING A CONNECTION BLOCK WHICH AUTOMATICALLY ELIMINATES BUBBLES TRAPPED ON A FILTER

BACKGROUND OF THE INVENTION

1. Field of the Invention

The present invention relates to an inkjet printer having a filter for removing foreign materials from ink, wherein the filter is disposed in an ink path for supplying ink to the inkjet head. More particularly, the present invention relates to an inkjet printer capable of avoiding print defects and other problems resulting from air bubbles trapped at the ink filter.

2. Description of Related Art

When foreign materials is present in the ink supplied from the ink tank to the inkjet head of an inkjet printer, the ink nozzles of the inkjet head can become clogged, leading to ink discharge problems and printing defects. A filter for removing such foreign materials is, therefore, commonly disposed in the ink supply path near the inkjet head to prevent the foreign materials from penetrating the inkjet head together with the ink.

Removable ink cartridges are now often used as the ink tank. Removing an empty ink cartridge to replace it exposes the ink supply path to the air, which can then enter the ink supply path and become trapped therein, forming a bubble. After the ink cartridge is replaced, and the ink charging operation is performed to supply ink from the ink cartridge to the inkjet head, the air bubble inside the ink supply path is also pushed toward the inkjet head.

No problems occur if the bubble is then expelled through the ink nozzles to the outside of the inkjet head. However, the bubble sometimes becomes trapped by the filter and, thus, remains inside the ink supply path. When a bubble becomes trapped by the filter, it becomes a nucleus around which other bubbles congregate, and the bubble gradually grows. This can lead to the following problems.

One problem is that, the trapped air bubble makes ink supply unstable. As a result, when the required volume of ink is not supplied to the ink nozzle, ink drop discharge defects occur. Furthermore, when the trapped bubble grows to a sufficient size, it can completely block ink drop discharge.

SUMMARY OF THE INVENTION

The present invention has been developed in light of the above noted problems. It is, therefore, an object of the present invention to provide an inkjet printer that can automatically eliminate bubbles trapped in the filter.

To achieve this and other objects, an inkjet printer according to the present invention includes: an inkjet head; an ink-intake opening formed in the inkjet head; a filter for removing foreign materials contained in ink supplied to the ink-intake opening, the filter being disposed in an ink path on an upstream side of the ink-intake opening; and a connection block disposed above the filter and having an ink path to the filter. The connection block has an ink-supply-line part wherein an ink-path portion is formed with a substantially constant shape in cross section, and an ink-path-connection part forms another ink-path portion extending from the bottom of the ink-supply-line part to the filter. The internal volume of the ink-path-connection part is equal to or less than the volume of a sphere internally tangent to the ink-supply-line part.

When a bubble trapped in the ink-path-connection part separates from the filter top, and becomes a spherical bubble, the bubble will not be larger than one which can pass through the ink-supply-line part. Therefore, the buoyancy of the ink acting on the trapped bubble automatically causes the bubble to rise through and pass out from the ink-supply-line part.

In one embodiment of the present invention, the ink-path-connection part of the connection block has a substantially conical shape. The resulting tapered shape thus permits the bubbles on the filter top to rise reliably along the tapered surface and pass out from the ink path.

In another embodiment of the present invention, the inside wall surface forming the ink-path-connection part is an inwardly bulging curved surface.

In yet another embodiment of the present invention, the ink-supply-line part and ink-path-connection part of the connection block are disposed substantially vertically. This arrangement assures that there is nothing on the inside surface of the ink-supply-line part and ink-path-connection part obstructing the rise of the bubble. Thus, bubbles are reliably expelled.

In another embodiment of the present invention, the sectional shape of the ink-path-connection part is substantially cylindrical. As a result, the shape of a spherical bubble rising due to buoyancy will not be disturbed and, thus, the bubble can pass smoothly up and out from the ink-supply-line part.

In yet another embodiment of the present invention, the filter is disposed at the ink-intake opening, near the inkjet head. Disposing the filter near the inkjet head assures that bubbles reliably can be prevented from entering the inkjet head.

In still yet another embodiment of the present invention, a bubble trap—for holding a bubble rising through the ink-supply-line part—is disposed above the connection block on an upstream side of the ink path. Bubbles, trapped at the filter, which then rise by buoyancy up through the connection block, can be captured and held in the bubble trap. As a result, once bubbles are removed from the filter surface, they can be prevented from flowing back through the ink-supply-line part to the filter wherein they would again become trapped at the filter surface.

BRIEF DESCRIPTION OF THE DRAWINGS

The above and other objects and advantages of the present invention, together with a fuller understanding thereof, will become apparent and appreciated by referring to the following description and claims taken in conjunction with the accompanying drawings, wherein:

DESCRIPTION OF THE PREFERRED EMBODIMENTS

Embodiment 1

A first preferred embodiment of an inkjet printer according to the present invention is described below, with reference to FIGS. 1–5.

Figure 1:
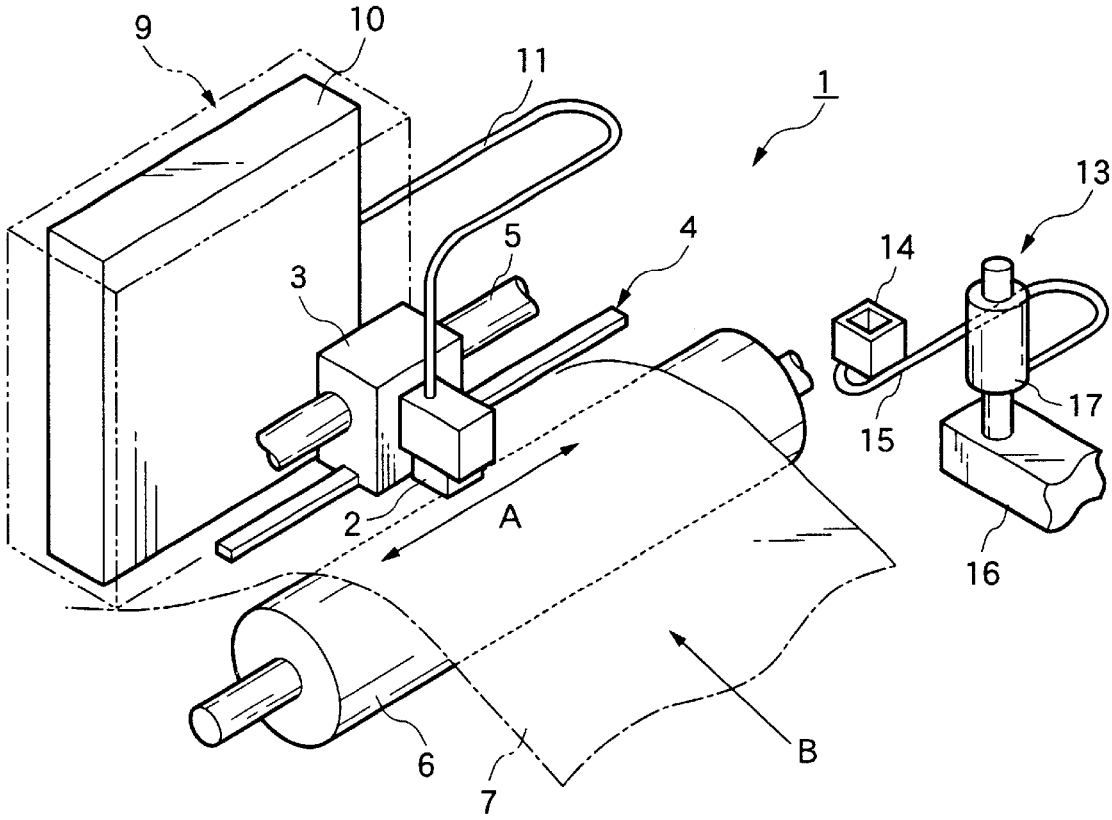
FIG. 1 is a schematic diagram of an inkjet printer according to the present invention.

FIG. 1 is a schematic diagram of an inkjet printer according to the present invention. As shown in FIG. 1, this inkjet printer 1 has an inkjet head 2, a carriage 3 supporting the inkjet head 2, a belt drive mechanism 4 for moving the carriage 3 bi-directionally in the main scanning direction as indicated by arrow A, and a guide shaft 5 for guiding the movement of the carriage 3.

The ink-nozzle surface of the inkjet head 2 faces downward in this exemplary embodiment. A platen roller 6 is disposed opposite and below the ink-nozzle surface. Printing paper 7 is advanced by platen roller 6 in the subscanning direction (indicated by arrow B) so that the desired text or graphic information can be printed on the surface of the printing paper 7.

Figure 2:
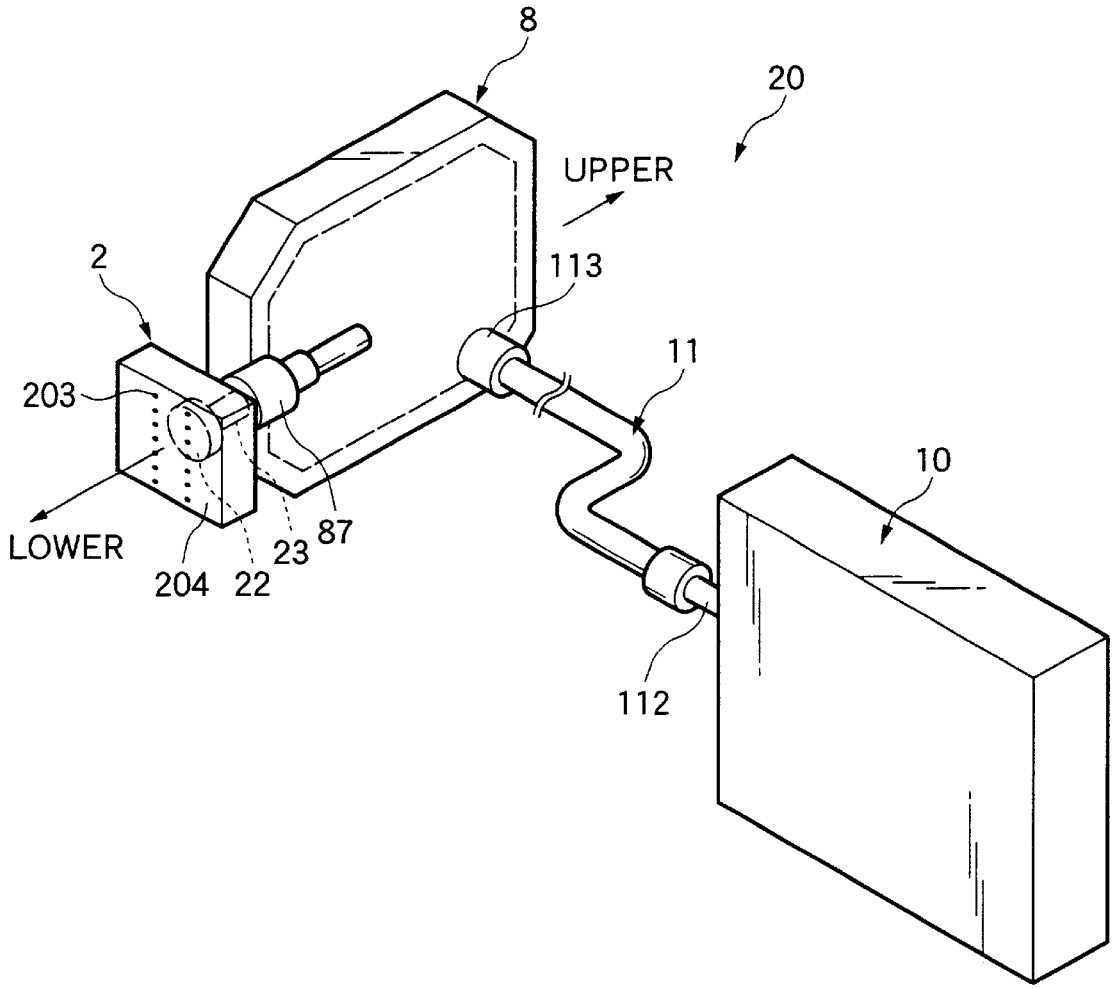
FIG. 2 shows the ink supply mechanism shown in FIG. 1.

Also, as shown in FIG. 2, mounted on the carriage 3 is an ink pressure attenuating mechanism 8. Ink is supplied from an ink cartridge 10, which is held removably on ink cartridge holder 9, through ink tube 11 and ink pressure attenuating mechanism 8, to the inkjet head 2.

A waste-ink recovery mechanism 13 is disposed at a position outside the print area in the main scanning direction of the inkjet head 2. This waste-ink recovery mechanism 13 has a cap 14 for capping the ink-nozzle surface of the inkjet head 2, and has a suction pump 17. Waste ink deposited into cap 14 is transferred by suction pump 17 into a waste-ink tank 16 through waste-ink tube 15.

Figure 3:
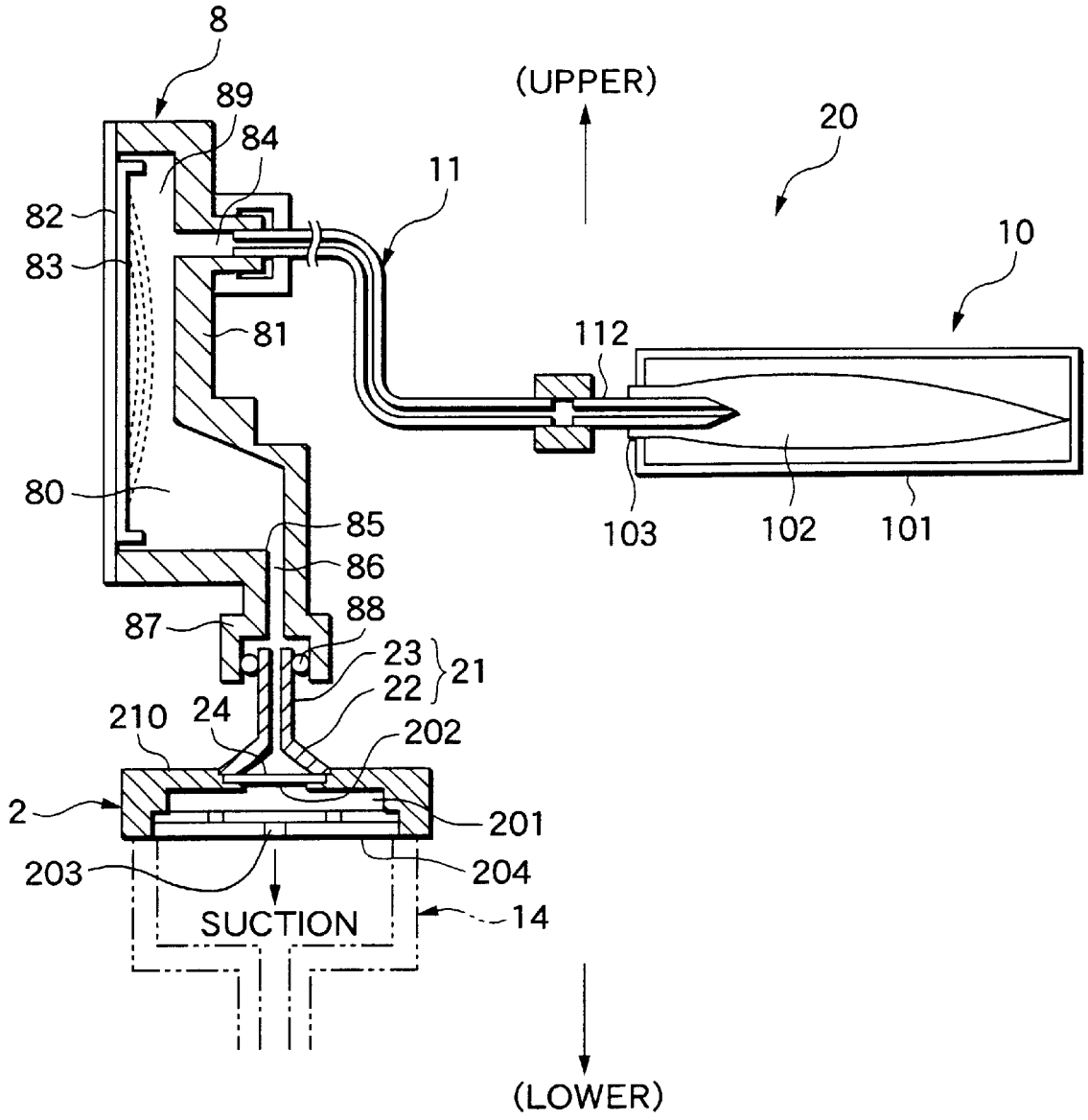
FIG. 3 is a section view of the ink supply mechanism shown in FIG. 2.

FIG. 2 shows the ink supply mechanism of FIG. 1, and FIG. 3 is a cross section view of the ink supply mechanism shown in FIG. 2. As shown in these figures, and as further described below, ink supply mechanism 20 generally includes ink cartridge 10, ink tube 11, and ink pressure attenuating mechanism 8.

The ink cartridge 10 has a flat, rectangularly shaped hard case 101, and a flexible ink sack 102 housed inside the hard case 101. Ink is sealed inside the ink sack 102. The ink sack 102 further has an ink outlet 103, which protrudes outside of hard case 101.

An ink supply needle 112, affixed to one end of ink tube 11, is inserted into ink outlet 103 of ink cartridge 10. The ink supply needle 112 is fixed to inkjet printer 1 such that installing and removing ink cartridge 10 causes the ink supply needle 112 to be inserted to and removed from ink outlet 103. The other end of ink tube 11 is connected to ink-pressure attenuating mechanism 8.

As shown in FIG. 3, the ink-pressure attenuating mechanism 8 has a flat, rectangularly shaped, hard case 81, a soft film 82 disposed on the hard case 81 so as to cover an opening in the hard case 81, and a leaf spring 83 affixed to the inside of the soft film 82. A pressure attenuation chamber 80 is formed between the hard case 81 and the soft film 82.

The hard case 81 also has an ink inlet 84 and an ink outlet 85 formed therein. The ink tube 11 is connected to the ink inlet 84, whereas the ink outlet 85 communicates with the top end of an ink-outflow path 86 formed in the hard case 81. The bottom end of this ink-outflow path 86 forms a large diameter head connector 87.

A specific volume of ink 40 is held in the pressure attenuation chamber 80 of the thusly formed ink pressure attenuating mechanism 8. As the internal pressure of pressure attenuation chamber 80 increases and decreases, the pressure change causes the soft film 82 and the leaf spring 83 to deform flexibly to the outside or inside, thereby adjusting the internal volume of the pressure attenuation chamber 80. Deformation of the soft film 82 thus functions to keep the internal pressure of the pressure attenuation chamber 80 constant. This means that even if the ink pressure at the ink inlet 84 varies, the ink supply pressure from ink outlet 85 to inkjet head 2 is kept constant.

Figure 4:
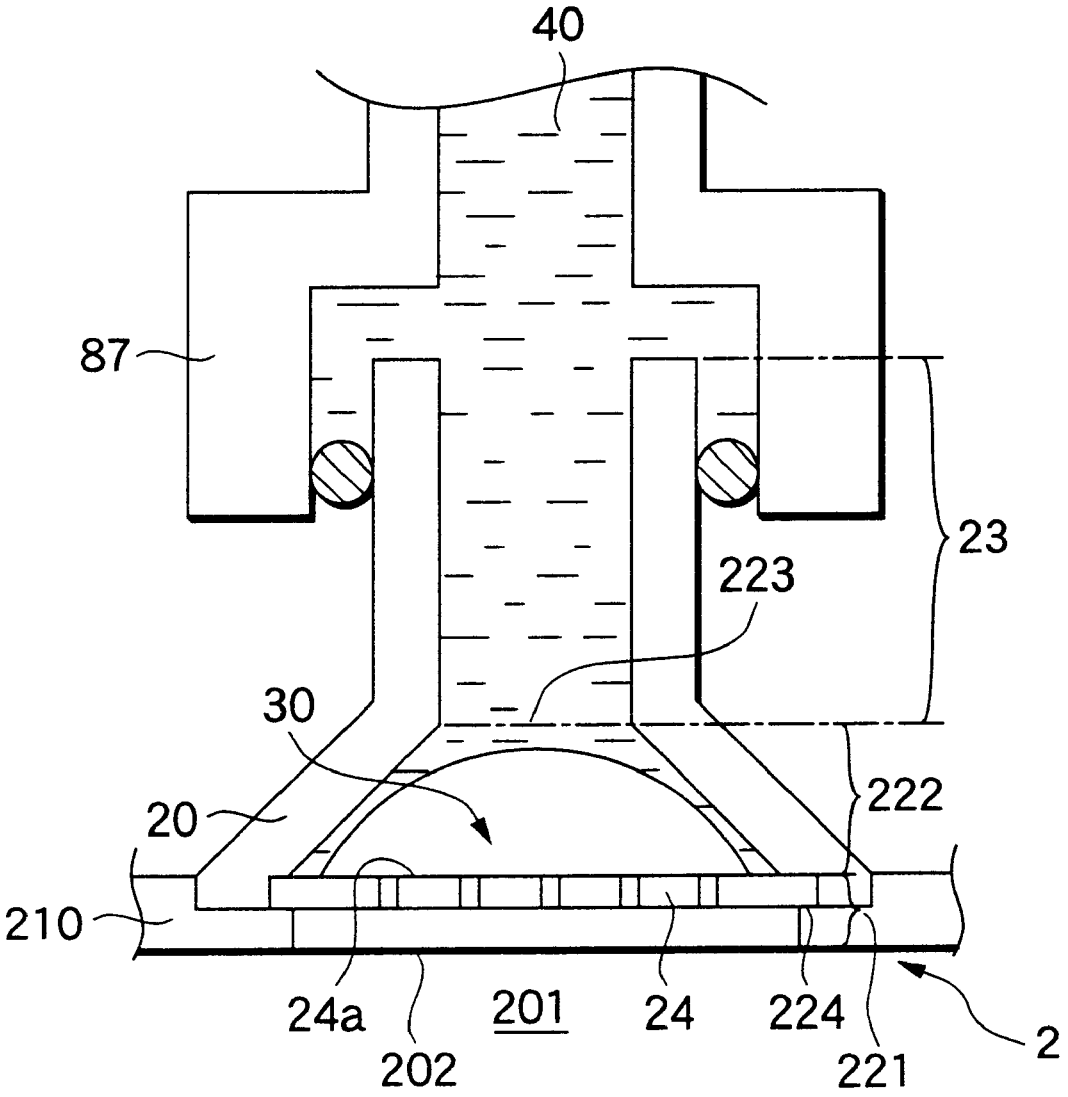
FIG. 4 is an explanatory diagram showing the ink supply path where the filter is disposed in the ink supply mechanism shown in FIG. 2.
Figure 5:
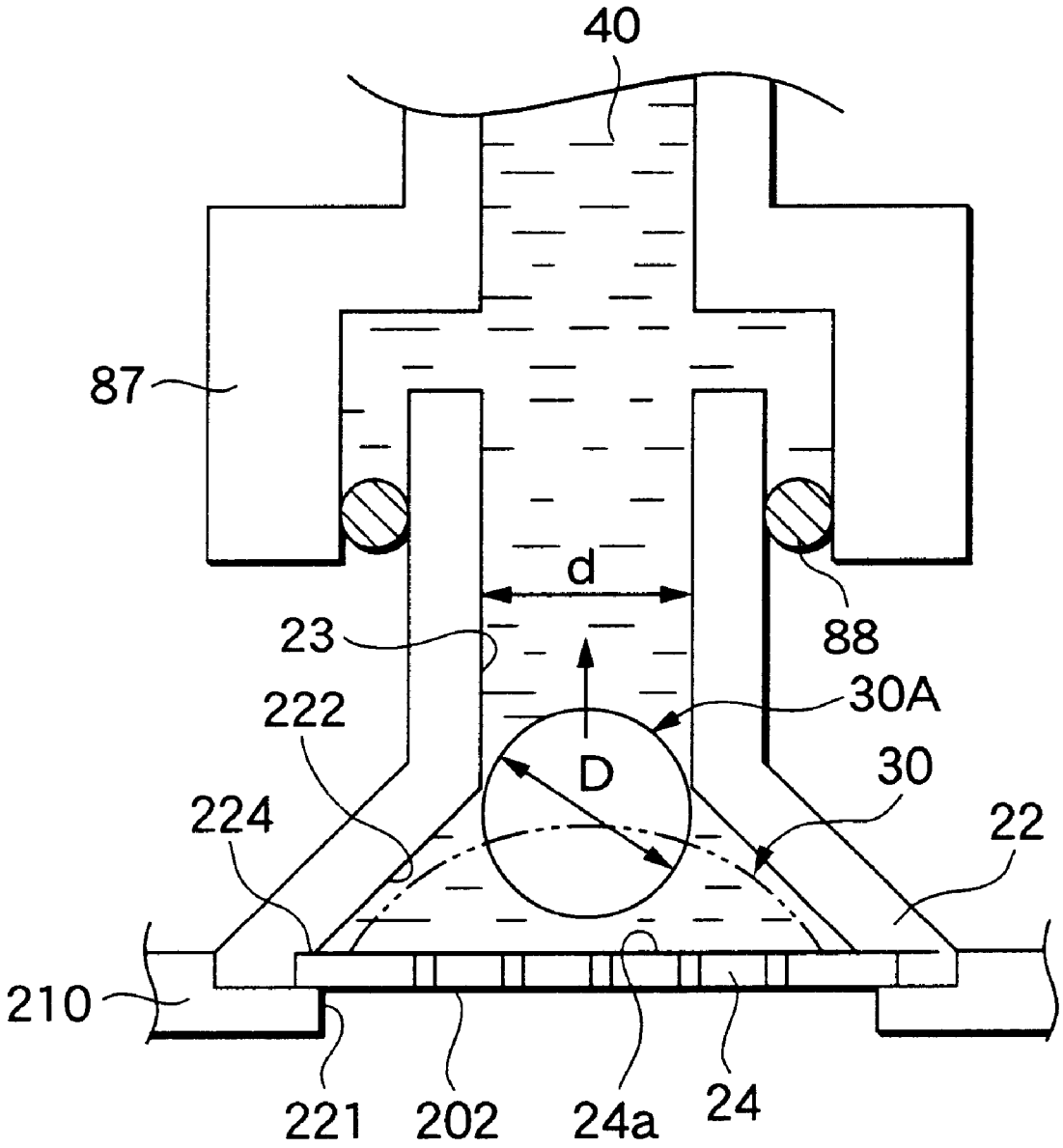
FIG. 5 is an explanatory diagram, similar to FIG. 4, but showing a bubble separating from and rising above the top surface of the filter.

Referring next to FIG. 3 and FIG. 4, inkjet head 2 has an ink chamber 201 for holding ink, and an ink-intake opening 202 for taking ink into the ink chamber 201. Ink is thus supplied from ink chamber 201 to the ink nozzles 203. As noted above, inkjet head 2 is held in carriage 3 so that the ink-nozzle surface 204 faces down. The ink-intake opening 202 is open to the unit case top 210 of inkjet head 2.

A connection block 21 is attached to the unit case top 210 at a position matching ink-intake opening 202. The connection block 21 has an ink-supply-line part 23 for connecting with ink pressure attenuating mechanism 8, and a generally conically shaped connector 22 having an ink-path-connection part 222. An ink path extends through the connection block 21.

The ink-supply-line part 23 is formed so that the internal diameter d is substantially constant and forms a first ink-path portion through the connection block 21. The top end part of the ink-supply-line part 23 is inserted from below into the head connector 87 so that packing 88 is deformed to prevent ink leakage.

A filter 24, for removing foreign materials from ink supplied from the connection block 21 to the inkjet head 2, is disposed directly above ink-intake opening 202, and is sandwiched between the connection block 21 and the unit case top 210.

Next, the structure of the ink-path-connection part 222, where filter 24 is disposed, and which forms a second ink-path portion through the connection block 21, will be described in detail. The ink-path-connection part 222 includes the ink path formed on the inside of connector 22—the inside of which is conically shaped—a large diameter bottom end 221 communicating with ink-intake opening 202, a small diameter top end 223 communicating with ink-supply-line part 23, and a filter holder 224 formed in the bottom end 221. Thus, the ink-path-connection part 222, is a conically shaped part extending from filter holder 224 to top end 223.

The internal volume of ink-path-connection part 222, between filter top 24*a* and top end 223, is the same as or less than 1.1 times the volume of a sphere internally tangent to ink-supply-line part 23, i.e., a sphere having a diameter d. For example, the internal volume of the ink-path-connection part 222 is set equal to the volume of a sphere internally tangent to ink-supply-line part 23.

As noted above, an air bubble can enter the ink supply path when the ink cartridge 10 of a inkjet printer 1 is replaced. Furthermore, when ink-nozzle surface 204 of inkjet head 2 is capped with cap 14, and ink is transferred by way of the ink suction operation of suction pump 17, a bubble 30 in the ink supply path can advance to filter 24. Once it has reached the filter 24, the bubble 30 becomes trapped by filter top 24*a*, forming a flattened hemisphere that can substantially cover the filter top 24*a*.

When ink suction stops, surface tension causes the bubble held against filter top 24*a* to become a spherical bubble 30A. Because the internal volume of the conical ink-path-connection part 222 is as noted above, a diameter D of the trapped spherical bubble 30A cannot become any greater than the internal diameter d of the upward-extending ink-supply-line part 23. The buoyancy of ink 40 causes bubble 30A to rise along the inside surface of the conical ink-path-connection part 222, and to travel into and through ink-supply-line part 23 which extends upward from the top of ink-path-connection part 222. The spherical bubble 30A thus exits from connection block 21, to which the filter 24 is attached.

Tests conducted using ink 40 with a specific gravity of 1.06, and an ink-supply-line part 23 having a 1.6 mm internal diameter, showed that the bubble reliably migrates upward and out if the internal volume of ink-path-connection part 222 is at most 1.1 times the volume of a sphere internally tangent to the ink-supply-line part 23 communicating with top end 223. Further, the tests showed that the bubble may or may not migrate upward and out if the ink-path-connection part internal volume is 1.2 times the volume of the sphere. Moreover, the tests showed that if the ink-path-connection part internal volume is 1.3 times the volume of the sphere, there is substantially no movement of the bubble.

It is thus apparent that a bubble 30 trapped at the filter top 24*a* will float away from filter top 24*a*, and will float upward and out from the ink-supply-line part 23 in this exemplary embodiment of the present invention, wherein the internal volume of the ink-path-connection part 222 is less than or equal to the volume of a sphere that is internally tangent to the ink-supply-line part 23. Problems arising from a bubble 30 remaining at the top surface 24*a* of the filter 24 can thus be reliably avoided.

Furthermore, because the ink-path-connection part 222 is conically shaped, a bubble 30 trapped at filter top 24*a* can float quickly upward from filter top 24*a*, and can float along the tapered inside surface of ink-path-connection part 222. It is thus also possible to avoid problems caused by bubbles being trapped in a corner area—i.e., where there is a horizontal downward facing surface formed inside the ink-path-connection part—when the bubble rises.

It is also preferable to form a bubble trap 89 for holding any bubble 30A which rises through the top of the vertically disposed ink-supply-line part 23. Such bubble trap 89 prevents bubbles from passing back to the filter 24.

The bubble trap 89 is formed in the top part of the attenuation chamber 80, above the ink inlet 84. As a result, pumping ink in inkjet head 2 from ink nozzles 203 will not pull any bubbles out of the bubble trap 89—and down to the filter 24—because ink in the pressure attenuation chamber 80 flows from ink inlet 84 down to inkjet head 2.

Embodiment 2

Figure 6:
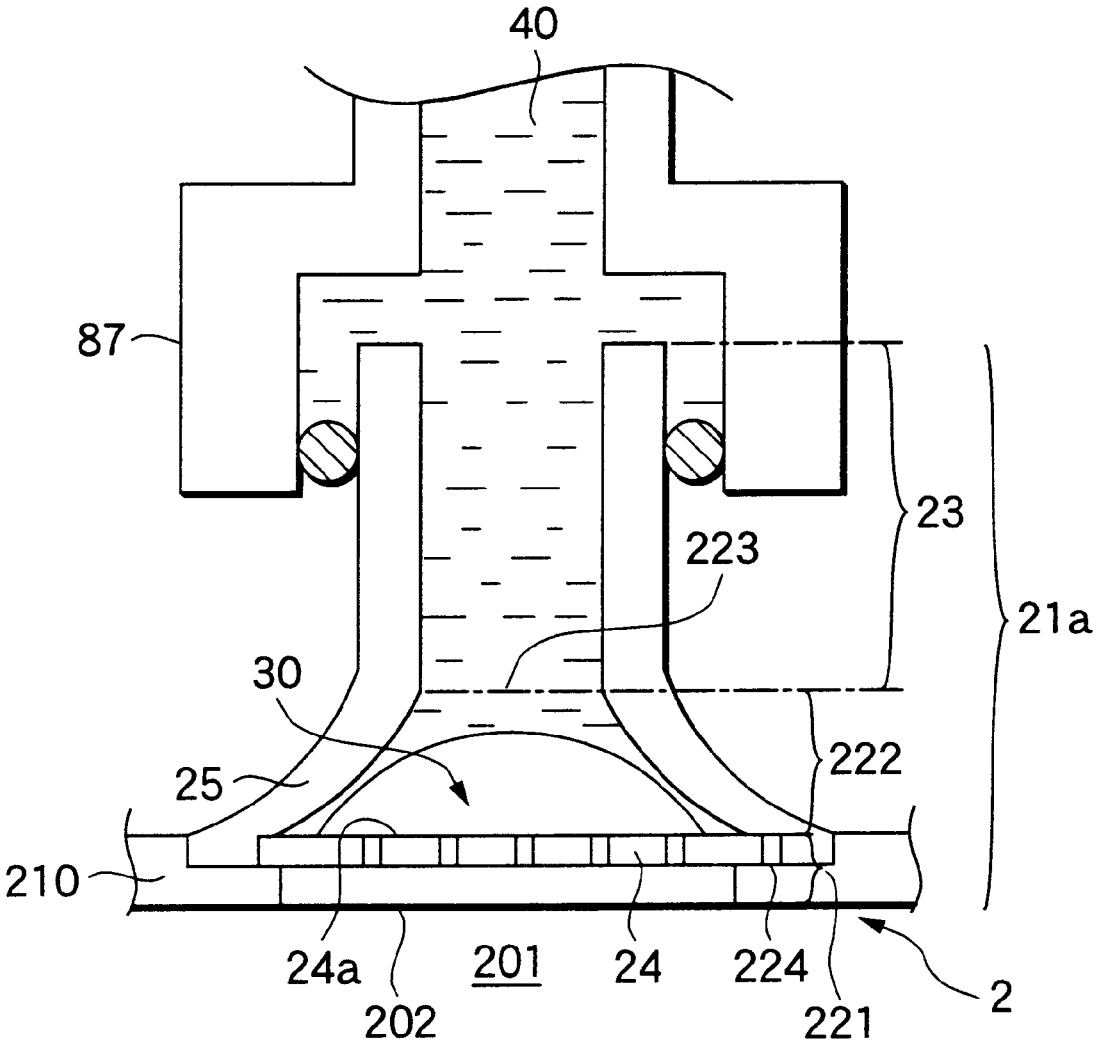
FIG. 6 is an explanatory diagram showing the ink path in the connection block for a second preferred embodiment of the present invention.

Next, with reference to FIG. 6, a connection block 21*a* according to a second embodiment of the present invention is described.

FIG. 6 is similar to FIG. 4 which shows the connection block 21 of the first embodiment. Further, the configuration and function of parts other than the connection block 21*a* are as noted in the above-described first embodiment. That is, like parts in this and the first embodiment are indicated by like reference numbers and, therefore, further description thereof is omitted.

It is apparent from FIG. 6 that the connection block 21*a* of this embodiment differs from the connection block 21 of the first embodiment in that it includes a connector 25, the inside wall of which connector 25 is curved.

Next, the structure of the ink-path-connection part 222, where the filter 24 is disposed, will be described in detail. The ink-path-connection part 222 includes the ink path formed on the inside of connector 25—the inside wall of which is curved—a large diameter bottom end 221 communicating with the ink-intake opening 202, a small diameter top end 223 communicating with the ink-supply-line part 23, and a filter holder 224 formed in the bottom end 221. Thus, the inside wall of the ink-path-connection part 222 is curved such that it bulges inwardly and narrows in diameter from filter holder 224 to top end 223.

The internal volume of the ink-path-connection part 222, between filter top 24*a* and top end 223, is the same as or less than 1.1 times the volume of a sphere internally tangent to ink-supply-line part 23. For example, the internal volume of ink-path-connection part 222 is set equal to the volume of a sphere internally tangent to ink-supply-line part 23, i.e., a sphere having a diameter that is the same as the inside diameter of the ink-supply-line part 23.

In addition to the above-described benefits of the first embodiment of the present invention, the structure of the second embodiment additionally makes it easier for bubbles to separate from the top surface of the filter.

Embodiment 3

Figure 7:
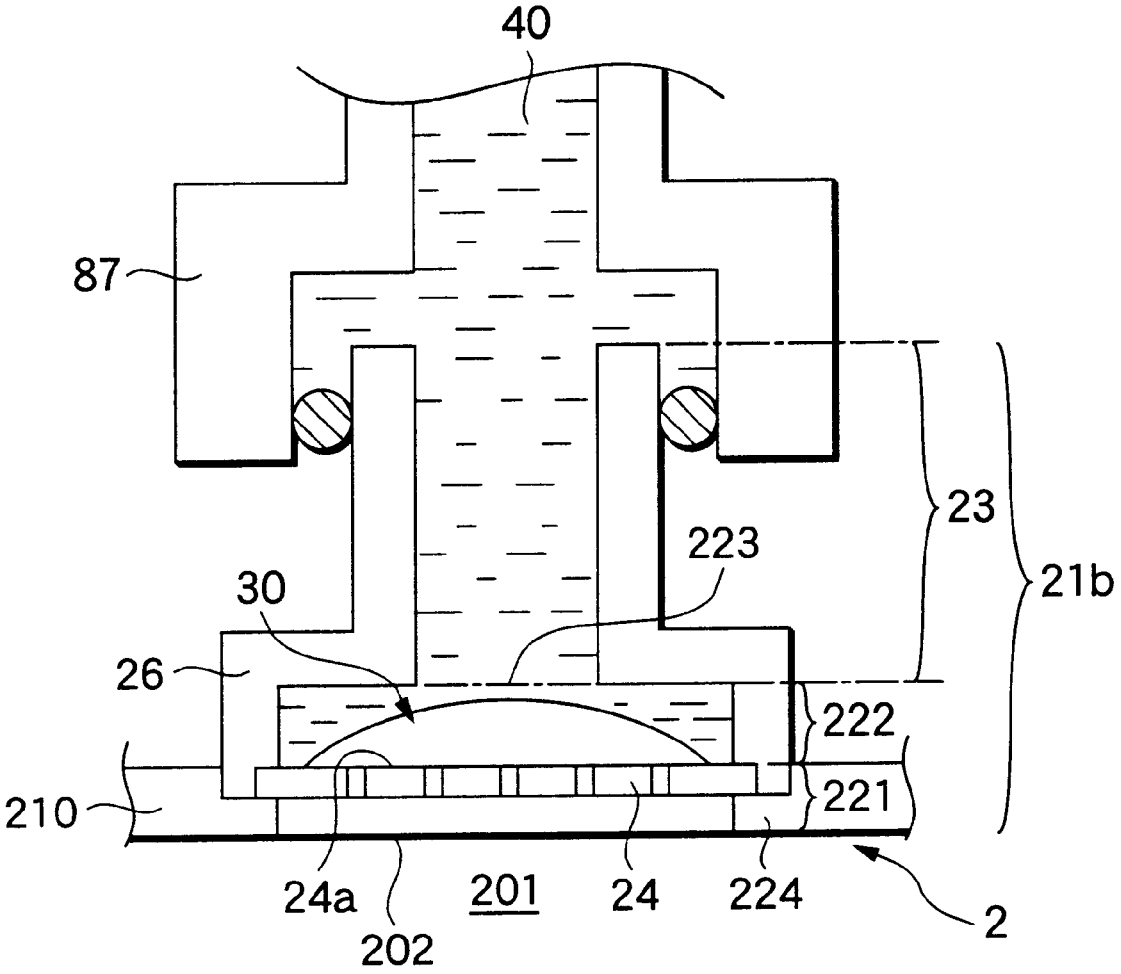
FIG. 7 is an explanatory diagram showing the ink path in the connection block for a third preferred embodiment of the present invention.

Next, with reference to FIG. 7, a connection 21*b* block according to a third embodiment of the present invention is described.

FIG. 7 is similar to FIG. 4 which shows the connection block 21 of the first embodiment. Further, the configuration and function of parts other than the connection block 21*b* are as noted in the above-described first embodiment. That is, like parts in this and the first embodiment are indicated by like reference numbers and, therefore, further description thereof is omitted.

It is apparent from FIG. 7 that the connection block 21*b* of this embodiment differs from the connection block 21 of the first embodiment in that it includes a connector 26. The inside wall of the connector 26 is cylindrical and is stepped relative to ink-supply-line part 23. This stepped configuration makes the connection block 21*b* easier to manufacture than the connection block 21 of the first embodiment.

Next, the structure of the ink-path-connection part 222, where filter 24 is disposed, will be described in detail. The ink-path-connection part 222 includes the ink path formed on the inside of the cylindrically shaped connector 26, a large diameter bottom end 221 communicating with ink-intake opening 202, a small diameter top end 223 communicating with the ink-supply-line part 23, and a filter holder 224 formed in the bottom end 221. The ink-path-connection part 222 is thus cylindrically shaped, and extends from the filter holder 224 to the top end 223.

The internal volume of the ink-path-connection part 222, between filter top 24*a* and top end 223, is the same as or less than 1.1 times the volume of a sphere internally tangent to ink-supply-line part 23, i.e., a sphere having a diameter which is the same as the inside diameter of the ink-supply-line part 23. For example, the internal volume of ink-path-connection part 222 is set equal to the volume of a sphere internally tangent to ink-supply-line part 23.

This embodiment of the present invention achieves substantially the same benefits as the first embodiment described above.

Embodiment 4

A connection block 21*c* according to a fourth embodiment of the present invention is described below with reference to FIG. 8.

Figure 8:
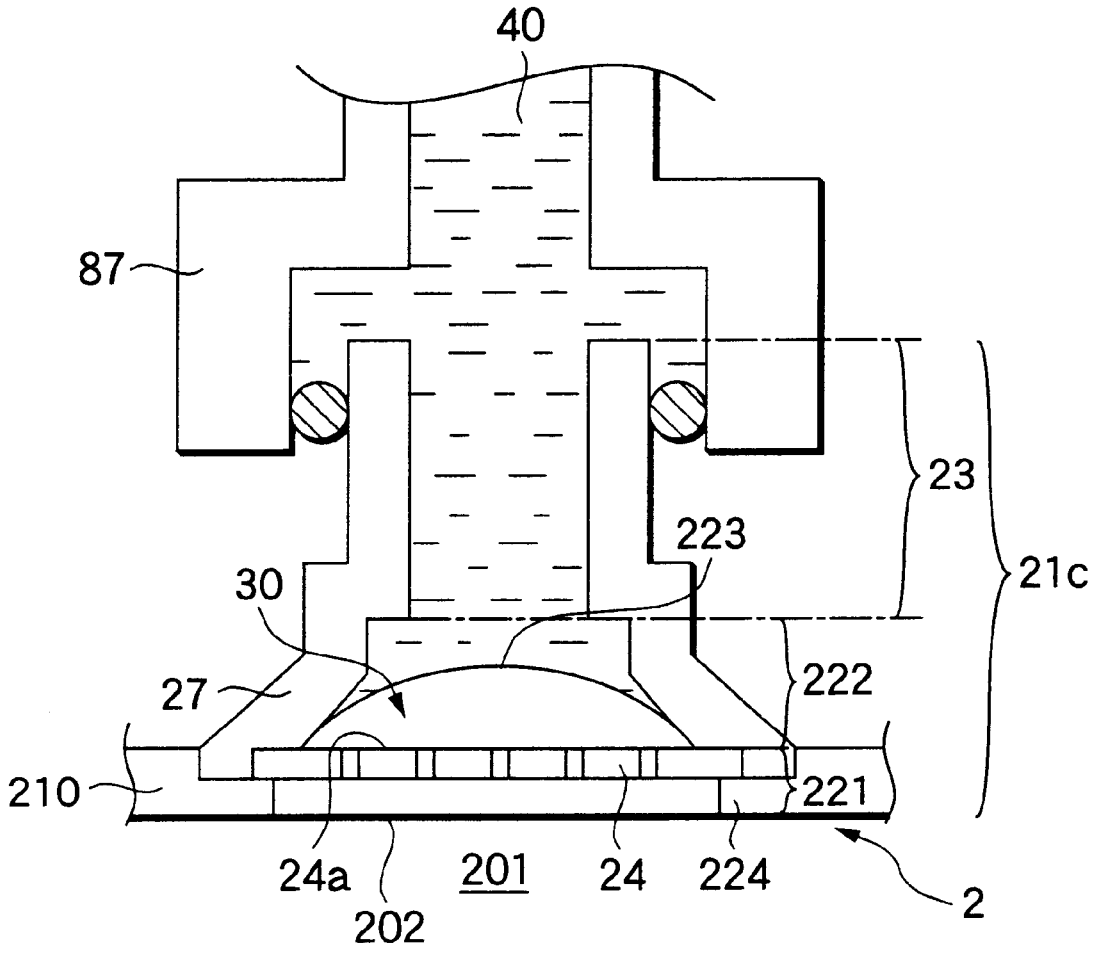
FIG. 8 is an explanatory diagram showing the ink path in the connection block for a fourth preferred embodiment of the present invention.

FIG. 8 is similar to FIG. 4 which shows the connection block 21 of the first embodiment. Further, the configuration and function of parts other than the connection block 21*c* are as noted in the above-described first embodiment. That is, like parts in this and the first embodiment are indicated by like reference numbers and, therefore, further description thereof is omitted.

It is apparent from FIG. 8 that the connection block 21*c* of this embodiment includes a connector 27, wherein the inside wall of the connector 27 is a combination of inside walls which are comparable to the inside wall configurations in the above-described first and third embodiments.

Next, the structure of the ink-path-connection part 222, wherein filter 24 is disposed, will be described in detail. The ink-path-connection part 222 includes the ink path formed on the inside of connector 27—the inside wall of which is both cylindrically shaped and conically shaped—a large diameter bottom end 221 communicating with the ink-intake opening 202, a small diameter top end 223 communicating with ink-supply-line part 23, and a filter holder 224 formed in the bottom end 221. Thus, the ink-path-connection part 222 is cylindrically and conically shaped, and extends from filter holder 224 to top end 223.

The internal volume of the ink-path-connection part 222, between filter top 24*a* and top end 223, is the same as or less than 1.1 times the volume of a sphere internally tangent to ink-supply-line part 23, i.e., a sphere have a diameter which is the same as the inner diameter of the ink-supply-line part 23. For example, the internal volume of ink-path-connection part 222 is set equal to the volume of a sphere internally tangent to ink-supply-line part 23.

This embodiment of the present invention achieves substantially the same benefits as the first embodiment described above.

It will also be obvious to one with ordinary skill in the art that the present invention can be changed in various ways without departing from the scope of the accompanying claims. For example, while the ink-nozzle surface 204 of inkjet head 2 is described as facing down in the preceding embodiments, the ink-nozzle surface can be oriented in other directions, including a direction wherein ink is discharged to the side.

Furthermore, the connection block 21, 21*a*, 21*b*, 21*c* is described as being disposed so that the ink-supply-line part 23 is substantially vertical. The orientation of the connection block can, however, be changed so that the ink-supply-line part 23 is at an angle of up to approximately 45 degrees to the horizontal. The ink-supply-line part 23 is, however, preferably vertical or nearly vertical because this angle makes it easiest for bubbles to separate from the filter surface and, therefore, is most effective.

Moreover, the filter 24 is described as being disposed at the ink-intake opening 202 to the ink chamber 201, but the invention is not so limited. For example, the filter 24 can be placed elsewhere in the ink path, separate from the inkjet head. But disposition of the filter 24 near the inkjet head 2 makes it easier to prevent bubbles from entering the inkjet head.

Still further, the ink-supply-line part 23 and bottom end 221 of the connection block 21, 21*a*, 21*b*, 21*c* are described as being circular in cross section, but they can also have other cross-sectional shapes such as, for example, square. What is important is that the internal volume of the ink-path-connection part 222 is equal to or less than 1.1 times the volume of a sphere internally tangent to the ink-supply-line part 23. With such an ink-path-connection-part volume, the benefits of the present invention, as described above, can be achieved.

According to the present invention, as described above, bubbles trapped at a filter—disposed in an ink supply path for removing foreign materials from ink supplied to an inkjet head of an inkjet printer—can, by the buoyancy of the ink, be separated automatically from the top surface of the filter and expelled to the outside of the ink supply path in which the filter is disposed.

It is, therefore, possible to avoid problems caused by an air bubble trapped at the filter, wherein such problems include unstable ink supply volume which results in print defects and in the inability to print. It is therefore possible to achieve an inkjet printer with high print reliability.

Although the present invention has been described in connection with preferred embodiments thereof, with reference to the accompanying drawings, it is to be noted that various changes and modifications will be apparent to those skilled in the art. Such changes and modifications are to be understood as included within the scope of the present invention as defined by the appended claims.

What is claimed is:

1. An inkjet printer comprising:

an inkjet head;

an ink-intake opening formed in the inkjet head;

a filter disposed at an upstream side of the ink intake opening;

a connection block disposed above the filter and forming an ink path therein, the ink path having:

an ink supply line part formed with a substantially constant shape in cross section along an ink flow direction; and an ink-path-connection part connecting the ink supply line part with the filter, and expanding in cross section in the ink flow direction, wherein an internal volume of the ink-path-connecting part is equal to or less than a volume of a sphere internally tangent to the ink supply line part.

2. An inkjet printer as described in claim 1, wherein the ink-path-connection part of the connection block is a substantially conical shape.

3. An inkjet printer as described in claim 2, wherein the inside surface forming the ink-path-connection part is an inwardly bulging curved surface.

4. An inkjet printer as described in claim 1, wherein the ink-supply-line part and ink-path-connection part of the connection block are disposed substantially vertically.

5. An inkjet printer as described in claim 1, wherein the ink-path of the ink supply line part is substantially cylindrical.

6. An inkjet printer as described in claim 1, wherein the filter is disposed adjacent to the ink-intake opening.

7. An inkjet printer as described in claim 1, further comprising:

a bubble trap for holding a bubble rising in the ink-supply-line part, said bubble trap being disposed above the connection block.

8. An inkjet printer as described in claim 2, wherein the ink-supply-line part and ink-path-connection part of the connection block are disposed substantially vertically.

9. An inkjet printer as described in claim 8, wherein the ink-path of the ink supply line part is substantially cylindrical.

10. An inkjet printer as described in claim 9, wherein the filter is disposed adjacent to the ink-intake opening.

11. An inkjet printer as described in claim 10, further comprising:

a bubble trap for holding a bubble rising in the ink-supply-line part, said bubble trap being disposed above the connection block.

12. An inkjet printer as described in claim 2, wherein the filter is disposed adjacent to the ink-intake opening.

13. An inkjet printer as described in claim 12, further comprising:

a bubble trap for holding a bubble rising in the ink-supply-line part, said bubble trap being disposed above the connection block.

* * * * *